US010958022B2

(12) United States Patent
Liu et al.

(10) Patent No.: US 10,958,022 B2
(45) Date of Patent: Mar. 23, 2021

(54) RADIO-FREQUENCY COAXIAL CABLE CONNECTOR WITH QUICK INSTALLATION

(71) Applicant: Jiangsu Hengxin Technology Co., Ltd., Yixing (CN)

(72) Inventors: YongKun Liu, Yixing (CN); Ke Shi, Yixing (CN); ChongHui Huang, Yixing (CN); WenBiao Dong, Yixing (CN)

(73) Assignee: Jiangsu Hengxin Technology Co., Ltd., Yixing (CN)

( * ) Notice: Subject to any disclaimer, the term of this patent is extended or adjusted under 35 U.S.C. 154(b) by 273 days.

(21) Appl. No.: 16/096,039

(22) PCT Filed: Apr. 20, 2018

(86) PCT No.: PCT/CN2018/083914

§ 371 (c)(1),
(2) Date: Oct. 24, 2018

(87) PCT Pub. No.: WO2019/062088

PCT Pub. Date: Apr. 4, 2019

(65) Prior Publication Data

US 2020/0358234 A1 Nov. 12, 2020

(30) Foreign Application Priority Data

Sep. 28, 2017 (CN) ..... 201710896838.7

(51) Int. Cl.
*H01R 24/56* (2011.01)
*H01R 9/05* (2006.01)
(Continued)

(52) U.S. Cl.
CPC ..... *H01R 24/564* (2013.01); *H01R 9/05* (2013.01); *H01R 13/502* (2013.01);
(Continued)

(58) Field of Classification Search
CPC .... H01R 24/564; H01R 9/05; H01R 13/5202; H01R 13/5205; H01R 13/502; H01R 13/5825
See application file for complete search history.

(56) References Cited

U.S. PATENT DOCUMENTS 4,046,451 A * 9/1977 Juds ..... H01R 24/566 439/583
4,902,246 A 2/1990 Samchisen
(Continued)

FOREIGN PATENT DOCUMENTS

CN 102832473 A 12/2012
CN 203850531 U 9/2014
CN 107800009 A 3/2018

*Primary Examiner* — Ross N Gushi

(57) ABSTRACT

A RF coaxial cable connector with rapid installation includes a front shell, a rear protective sleeve, a front insulator, a center conductor, a rear insulator, a cable crimping ring, and a cable clamping assembly. The front insulator, the center conductor and the rear insulator are arranged in a front-rear sequence in a cavity of the front shell. The cable crimping ring has a front end surface abutting on an outer ring end surface of a rear end surface of the rear insulator, and is connected with the front shell. The rear protective sleeve is connected with the front shell. The cable clamping assembly is arranged in an inner cavity of the rear protective sleeve, and has a clamping surface formed thereon for clamping on an outer ring surface of an outer conductor of a cable to be connected.

9 Claims, 4 Drawing Sheets

(51) Int. Cl.
*H01R 13/502* (2006.01)
*H01R 13/52* (2006.01)
*H01R 13/58* (2006.01)

(52) U.S. Cl.
CPC ..... *H01R 13/5202* (2013.01); *H01R 13/5205* (2013.01); *H01R 13/5825* (2013.01)

(56) References Cited

U.S. PATENT DOCUMENTS

| | | | | |
|---|---|---|---|---|
| 5,007,861 | A | 4/1991 | Stirling | |
| 7,357,671 | B2 * | 4/2008 | Wild | H01R 24/566 439/583 |
| 7,357,672 | B2 * | 4/2008 | Montena | H01R 9/0524 174/59 |
| 8,038,472 | B2 * | 10/2011 | Montena | H01R 9/0524 439/578 |
| 8,177,583 | B2 * | 5/2012 | Chawgo | H01R 24/56 439/584 |
| 9,190,762 | B2 * | 11/2015 | Xu | H01R 24/564 |
| 9,425,548 | B2 * | 8/2016 | Van Swearingen | H01R 24/44 |

* cited by examiner

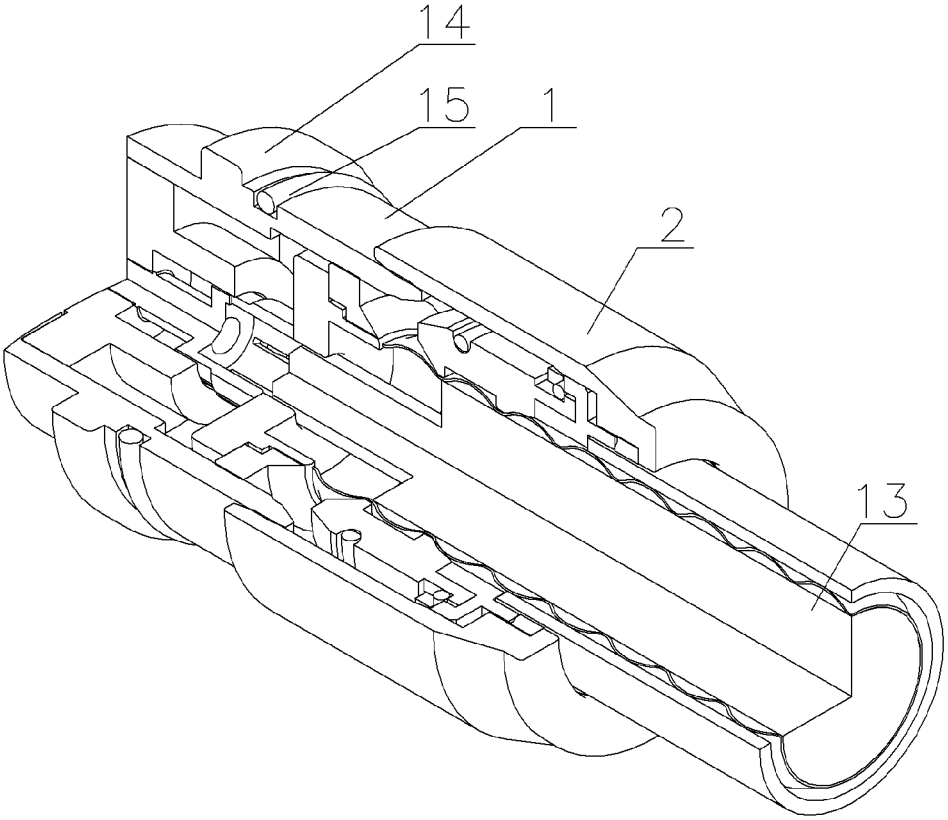
Fig. 2
Fig. 3
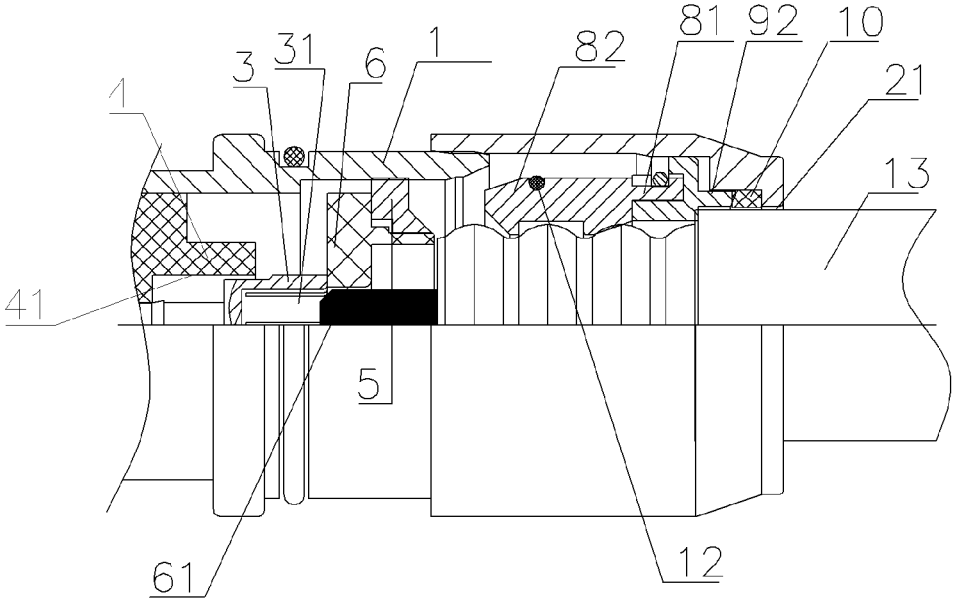

RADIO-FREQUENCY COAXIAL CABLE CONNECTOR WITH QUICK INSTALLATION

CROSS-REFERENCE TO RELATED APPLICATIONS

This application is a U.S. National Stage Application under 35 U.S.C. 371 of PCT Application No. PCT/CN2018/083914 having an international filing date 20 Apr. 2018, which PCT application claims the benefit of CN Application No. 201710896838.7 filed 28 Sep. 2017, the entire disclosures of which are hereby incorporated herein by reference.

TECHNICAL FIELD OF THE INVENTION

The invention relates to the technical field of RF (Radio-Frequency) coaxial cable connectors, and more particularly, to a RF coaxial cable connector with rapid installation.

BACKGROUND TECHNOLOGY OF THE INVENTION

In the prior art, a radio-frequency coaxial cable connector commonly comprises an installation type, a soldering type and a crimp-connection type. The traditional installation-type connector adopts a threaded-connection structure, which can be conveniently disassembled. Although its cost is much higher than the other two, but its advantage is that it is flexible in the construction of the project and can be adjusted according to the actual length or connection type. According to the investigation, for a skilled operator spends 2-3 minutes in installing one connector. For a novice who needs to follow the instruction manual, the process usually takes more than 10-15 minutes. Under the circumstances, the connector may not be installed improperly, resulting in a poor operating performance index.

At present, the internal structure of the same-model connectors sold in domestic is nearly the same as that sold in abroad, and their shortcomings on the electrical performance are also basically consistent, especially in the industry with more dynamic intermodulation. In view of the problem of dynamic intermodulation, we have also carried out more experimental analysis. In addition to the factors such as the material and the electroplating, it is mainly affected by the clamping force that the connector cable clamp imposes on the cable outer conductor, and the clamping force that the connector jack imposes on the cable inner conductor. The cable outer conductor is only partially clamped by the connector, and the gap between the other parts of the connector and the cable outer conductor is large. Due to the shaking of the cable outer conductor, mutual adjustment is not stable under the dynamic condition. Likewise, the cable inner conductor is not sufficiently clamped. The aforesaid are two main factors that affect the stability of the dynamic intermodulation.

With the increasing requirements of the base station system for the performance of each component and the increasing cost of artificial construction, it's urgent for those skilled in the art to develop a novel connector that has a high stability and can be conveniently installed.

SUMMARY OF THE INVENTION

The aim of the invention is to overcome the shortcomings of the prior art by providing a RF coaxial cable connector with rapid installation, which is characterized in simple and rapid installation, high mechanical stability, and consequently high product competitiveness.

A RF coaxial cable connector with rapid installation of the invention comprises:

a front shell, having an inner ring surface, an rear outer ring surface and a cavity;

a rear protective sleeve, having an inner cavity and a front inner ring surface, the rear protective sleeve being connected with the front shell rear in a positioned manner by an interference fit between the front inner ring surface of the rear protective sleeve and the outer ring surface of the front shell;

a front insulator, provided with a first positioning hole formed at a center axial position thereof;

a center conductor, provided with a second positioning hole formed at a center axial position thereof;

a rear insulator, provided with a through hole formed at a center axial position thereof, and having a rear end surface comprising an outer ring end surface; the front insulator, the center conductor and the rear insulator being arranged in a front-rear sequence in the cavity of the front shell;

a cable crimping ring, having a front end surface abutting on the outer ring end surface of the rear end surface of the rear insulator, and an outer ring end surface, the cable crimping ring being connected with the front shell in a positioned manner by an interference fit between the outer ring end surface of the cable crimping ring and the inner ring surface of the front shell; and a cable clamping assembly, arranged in the inner cavity of the rear protective sleeve, and having a clamping surface formed thereon for clamping on an outer ring surface of an outer conductor of a cable to be connected.

Further, the connector comprises a first sealing ring sleeved on an inner side of a blocking protrusion of an outer ring end face of the front shell, wherein once the cable is connected in place, an outer ring surface of the first sealing ring is tightly attached to an inner ring surface of the rear protective sleeve, for better sealing.

The cable clamping assembly comprises a base and a cable clamp, the base being connected to the rear protective sleeve by an interference fit between an outer ring surface of the base and a corresponding inner ring surface of the rear protective sleeve, wherein the cable clamp has a rear end barb structure clamped in a corresponding slot hole of the base, and a clamping surface formed on an inner end ring surface thereof.

The cable clamp has a circular ring structure formed by four sections spliced in a circumferential direction, each of the sections of the cable clamping has a rear end barb structure positioned in the corresponding slot hole.

The cable clamping structure comprises a first protrusion, an inner concave section and a second protrusion, which form a clamping structure.

The cable clamp is sleeved with an O-shaped ring on a front outer ring surface thereof, and a clamping spring on a rear outer ring surface thereof; while the cable is connected in place, the outer ring surface formed on the cable clamp is pushed into the inner cavity in a rear end of the front shell.

The slot hole is provided with a clamping spring mounting cavity, in which the clamping spring is positioned and sleeved on a rear end outer ring surface of the cable clamp.

The base is provided with an axial rear protruding ring which is configured to be inserted into a corresponding mounting slot of the rear protective sleeve, a sealing ring is arranged between a rear end of the axial rear protruding ring and an inner end wall of the mounting slot, an inner ring surface of the sealing ring is sleeved on an outer ring surface of the protective sleeve of the cable to be connected while assembled.

While pre-installed, a gap is provided between a rear end surface of a main body of the base and a corresponding positioning end surface of the rear protective sleeve, and the axial rear protruding ring has an inclined rear end ring surface; during crimping, by means of the rear end surface of the main body of the base and the positioning end surface of the rear protective sleeve, which are served as limiting surfaces, the sealing ring is squeezed and deformed for better sealing.

The diameter of the first positioning hole is smaller than that of the first through-hole, so as to ensure the inner conductor of the cable can be better fastened.

With the structure of the invention, the cable to be connected, needs to be stripped and pre-installed first, wherein a foaming treatment is required for the cable before the stripping. A pre-placed tag on the cable protective sleeve, or a "click" sound, may be used to indicate the complete of the pre-installation. While the pre-installation is completed, the inner conductor of the cable is already located in the second through-hole of the rear insulator, such that the inner conductor is inserted into the first through-hole of the center conductor with guaranteed concentricity. In a subsequent crimp-to-connect process, the outer conductor of the cable is abutted against the cable crimping ring. As the cable crimping ring and the front shell are in an interference fit, the outer conductor is squeezed and deformed, and consequently folded and clamped between the clamping surface of the cable clamping assembly and the cable crimping ring. While the crimping force imposed on the cable is greater than the resistance between the cable crimping ring and the shell, the cable crimping ring starts to move, thereby pushing the rear insulator and the center conductor to move forward, consequently pushing the center conductor into the first positioning hole so that the cable inner conductor can be better fastened. Furthermore, as the connector is pre-installed, unscrewing to separate the front and rear shells and reinstalling them are no longer needed. It just needs to insert the cable, which is stripped in advance according to dimensional requirements, into the connector, and crimp-to-connect them by a tool, the process is a quick and simple. The front and rear shells of the present invention are connected in an interference-fit manner, many tests show that the tensile strength of the connector according to the invention is much greater than that of the conventional thread-connection structure.

BRIEF DESCRIPTION OF THE DRAWINGS

Further advantages and configurations are explained in more detail in the following text on the basis of preferred exemplary embodiments of the invention, and in conjunction with the accompanying drawings, in which:

FIG. 2 is a front semi-sectional view of the RF coaxial cable connector according to the invention;

FIG. 3 is a sectional view of the RF coaxial cable connector according to the invention;

LIST OF NUMERALS

Front Shell 1
Blocking Protrusion 14
Rear Protective Sleeve 2
Center Conductor 3
Second Positioning Hole 31
Front Insulator 4
First Positioning Hole 41
Cable Crimping Ring 5
Rear Insulator 6
First Through-hole 61
Cable Clamping Assembly 7
Cable Clamp 8
Rear End Barb Structure 81
Cable Clamping Section 82
First Protrusion 821
Inner Concave Section 822
The Second Protrusion 823
Base 9
Slot Hole 91
Axial Rear Protruding Ring 92
Sealing Ring 10
Clamping Spring 11
O-shaped Ring 12
Cable 13
First Sealing Ring 15

DETAILED DESCRIPTION OF THE INVENTION

Figure 1:
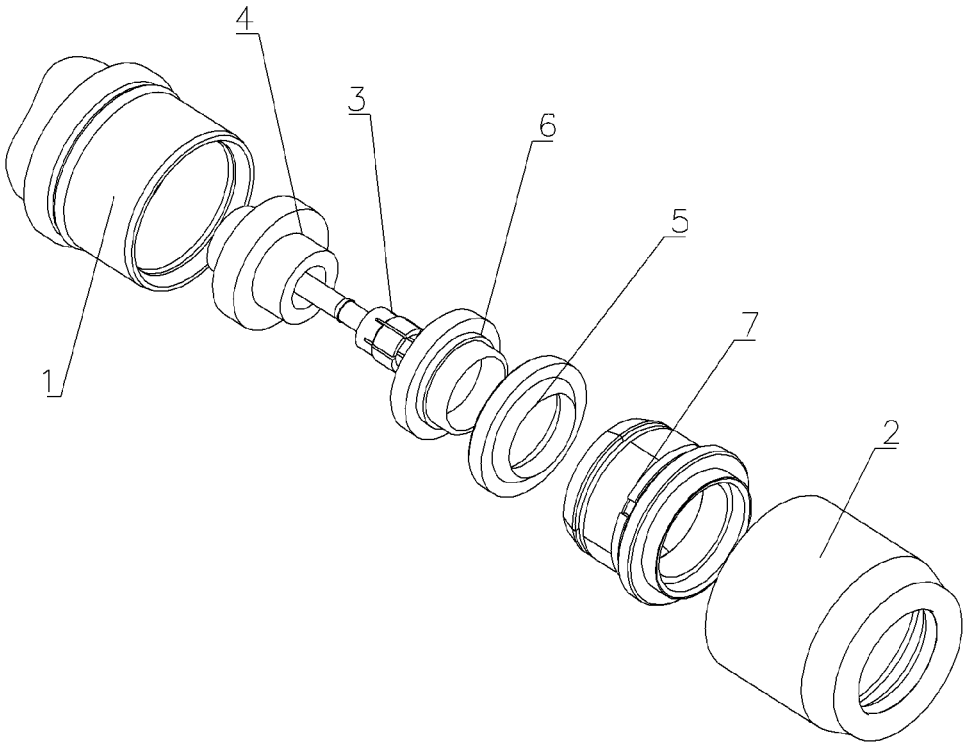
FIG. 1 is an explosive view of a RF coaxial cable connector with rapid installation according to the invention.
Figure 4:
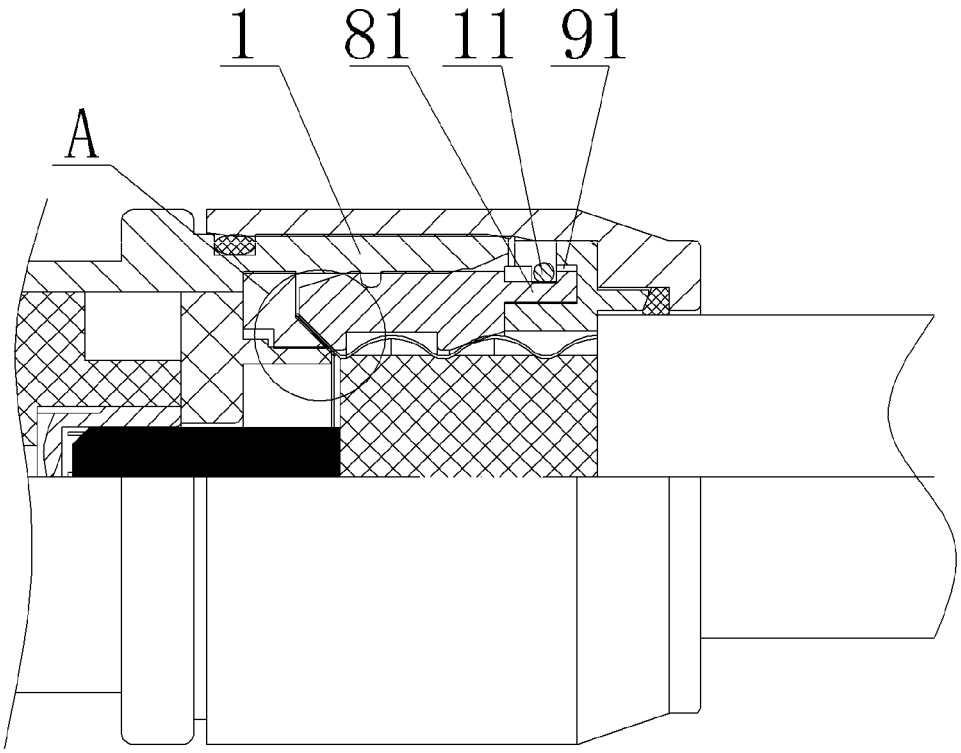
FIG. 4 is schematic views showing a sealing ring before and after crimped according to the invention.
Figure 5:
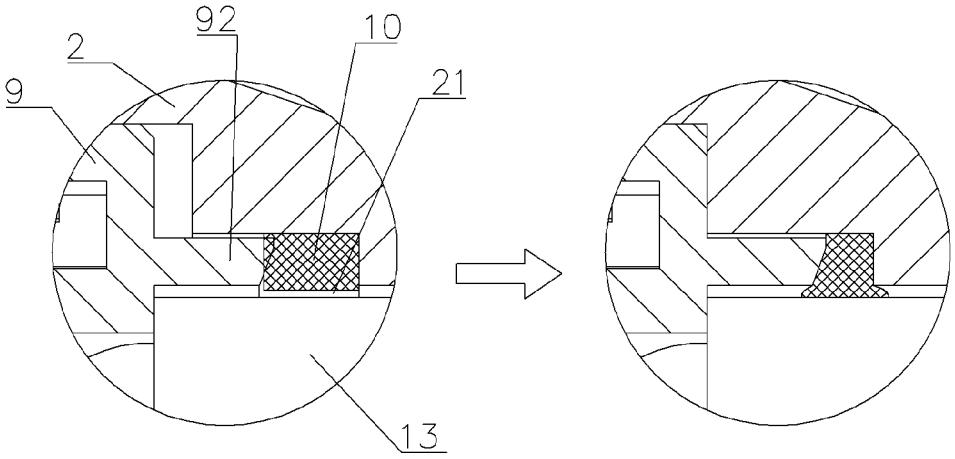
FIG. 5 is a schematic view of a crimp-connection according to the invention.
Figure 6:
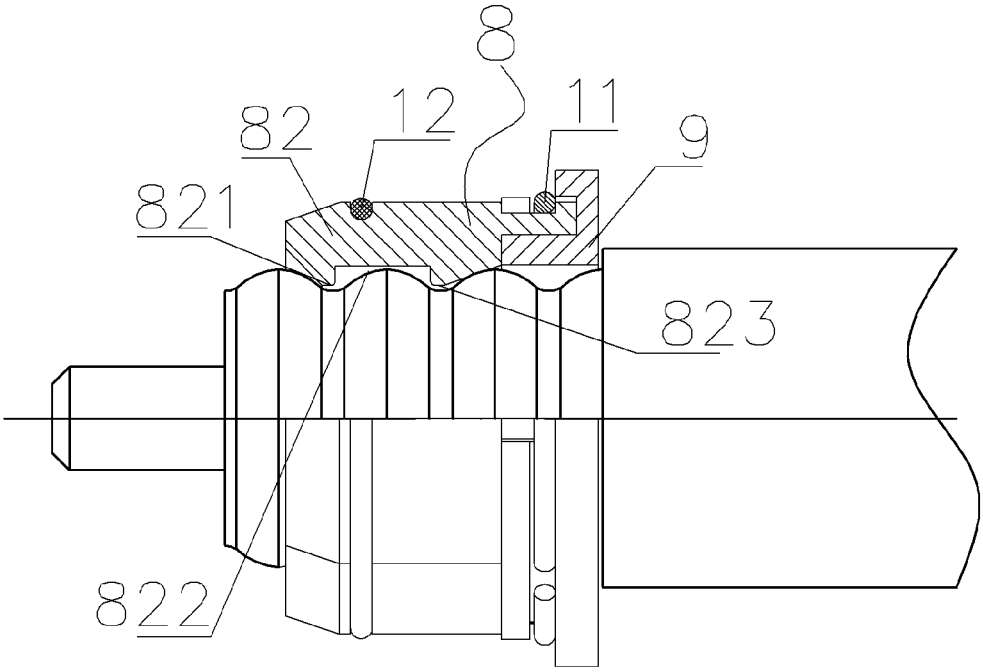
FIG. 6 is an enlarged view of the portion A in FIG. 5, illustrating an outer conductor of a cable which is double-layer crimp-connected, according to the invention.
Figure 7:
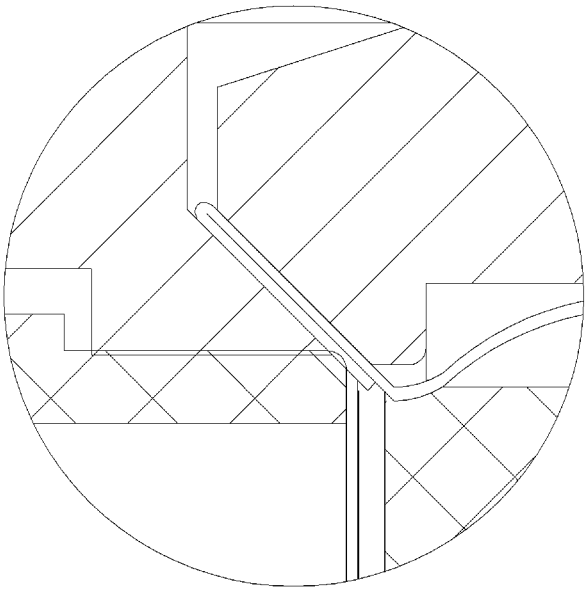
FIG. 7 is a partially sectional view of a cable clamping assembly installed according to the invention.

As shown in FIGS. 1-7, a RF coaxial cable connector according to the invention comprises a front shell 1, a rear protective sleeve 2, a front insulator 4, a center conductor 3 and a rear insulator 6. The front insulator 4, the center conductor 3 and the rear insulator 6 are arranged in a front-rear sequence in a cavity of the front shell 1, and provided with a first positioning hole 41, a second positioning hole 31 and a first through-hole 61 formed in center axial positions thereof, respectively. A front-end surface of a cable crimping ring 5 is pressed on an end surface of an outer ring portion of a rear end surface of the rear insulator 6. An outer ring end surface of the cable crimping ring 5 and an inner ring surface of the front shell 1 are positioned with each other and connected in an interference fit. A rear outer ring surface of the front shell 1 and a front inner ring surface of the rear protective sleeve 2 are positioned with each other and connected in an interference fit. The connector further comprises a cable clamping assembly 7 arranged in an inner cavity of the rear protective sleeve 2. The cable clamping assembly 7 has a clamping surface formed thereon configured to clamp an outer ring surface of an outer conductor of a cable 13 to be connected.

The front shell 1 on an outer ring end face thereof is provided with a blocking protrusion 14, on of which an inner side a first sealing ring 15 is sleeved. Once the cable 13 is connected in place, an outer ring surface of the first sealing ring 15 is abutted against to an inner ring surface of the rear protective sleeve 2, for better sealing.

The cable clamping assembly 7 comprises a base 9 and a cable clamp 8. An outer ring surface of the base 9 and a corresponding inner ring surface of the rear protective sleeve 2 are connected in an interference fit. The cable clamp 8 has a rear end barb structure 81 clamped in a corresponding slot hole 91 of the base 9. A clamping surface is formed on a ring surface of an inner end of the cable clamp 8.

In an embodiment, the cable clamp 8 has a circular ring structure formed by four cable clamping sections 82 spliced in the circumferential direction. The rear end barb structure 81 of each of the cable clamping sections 82 is positioned in the corresponding slot hole 91.

In a sectional view, each of the cable clamping section 82 comprises a first protrusion 821, an inner concave section 822 and a second protrusion 823, form a clamping structure altogether.

The connector of the invention further comprises an O-shaped ring 12 sleeved on an outer ring surface of an front end of the cable clamp 8, and a clamping spring 11 sleeved on an outer ring surface of an rear end of the cable clamp 8. Once the cable 13 is connected in place, the outer ring surface formed on the cable clamp 8 is pushed into a rear inner cavity the front shell 1.

The slot hole 91 has a clamping spring mounting cavity therein, in which the clamping spring 11 is positioned and sleeved on the rear end outer ring surface of the cable clamp 8.

The base 9 comprises an axial rear protruding ring 92 inserted in a corresponding mounting slot 21 of the rear protective sleeve 2. A sealing ring 10 is arranged between a rear end of the axial rear protruding ring 92 and an inner end wall of the mounting slot 21. Once assembled, the inner ring surface of the sealing ring 10 is sleeved on the outer ring surface of a protective sleeve of the cable 13 to be connected, for better water-proof performance.

During a pre-installation process, a gap is reserved between a rear end surface of the main body of the base 9 and a corresponding positioning end surface of the rear protective sleeve 2. The axial rear protruding ring 92 has an inclined ring surface on the rear end thereof. In a crimping process, the rear end surface of the main body of the base 9 and the positioning end surface of the rear protective sleeve 2 are served as limiting surfaces, such that the sealing ring 10 is pressed and deformed for sealing. The diameter of the first positioning hole 41 is smaller than the outer diameter of the center conductor 3, allowing an inner conductor of the cable to be better fastened. While the cable is inserted, the cable clamping sections 82 are forced to open, against the clamping spring 11 and the O-shaped ring 12. While the external force is removed, the cable clamping sections 82 is reverted to its original state under the action of the clamping spring 11 and the O-shaped ring 12. The cable clamp 8 has a first protrusion 821 and a second protrusion 823 arranged thereon and clamped in the troughs of the outer conductor of the cable, thereby preventing the cable from moving.

The r radio-frequency coaxial cable connector with rapid installation according to the invention has the beneficial effects as follows:

First of all, according to the invention, the connector is pre-installed, such that one can directly insert the cable, which is stripped in required dimensions, into the connector, and crimp them together with a crimping tool, without unscrewing and reinstating the front and rear shells, a resulting installation process is quick and simple.

Next, instead of a conventional threaded-connection structure, in the invention the interference-fit connection is adopted to secure the front and rear shells, some tests show that the tensile strength of the connection to the cable according to the invention is obviously greater than that of the conventional thread-connection structure.

The third, according to the invention the split structure is adopted for the cable clamp, in detail the cable clamp and the base are fixed through the barb structure and the clamping spring, the cable clamp at the front portion thereof is constrained by an elastic rubber element (the O-shaped ring), such that cable clamp is expandable. Compared with a conventional slotted copper cable clamp that cannot restore automatically after installation, the cable clamp of the invention can be forced open to receive the cable while the cable is inserted into the connector, the resulting installation process is time-saving and labor-saving;

The fourth, the cable clamp of the invention is designed to comprise two troughs as cable fixing points, so that the outer conductor of the cable can be better fixed, and the potential displacement of the outer conductor in the connector can be effectively reduced during the shaking of the cable, for better stability.

The fifth, instead of a conventional single-layer clamping structure, according to the invention the cable clamp and the outer conductor are clamped by a double-layer copper strip for a firmer clamping connection.

The sixth, as the cable inner conductor is clamped by the slotted tail portion of the connector slot, the clamped portion of the inner conductor is forced into the front insulator during the crimp-connection process, and the aperture of the front insulator is smaller than the outer diameter of the slotted portion of the connector, such that the clamped portion can be protected by the front insulator, greatly increasing the clamping force imposed on the cable inner conductor.

The last, the connector and the sealing ring on the cable protective sleeve are squeezed and deformed in the crimping process, the water-proof performance of the connector is thus enhanced.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A RF coaxial cable connector with rapid installation, comprising:

a front shell, having an inner ring surface, an rear outer ring surface and a cavity;

a rear protective sleeve, having an inner cavity and a front inner ring surface, the rear protective sleeve being connected with the front shell rear in a positioned manner by an interference fit between the front inner ring surface of the rear protective sleeve and the outer ring surface of the front shell;

a front insulator, provided with a first positioning hole formed at a center axial position thereof;

a center conductor, provided with a second positioning hole formed at a center axial position thereof;

a rear insulator, provided with a through hole formed at a center axial position thereof, and having a rear end surface comprising an outer ring end surface; the front insulator, the center conductor and the rear insulator being arranged in a front-rear sequence in the cavity of the front shell;

a cable crimping ring, having a front end surface abutting on the outer ring end surface of the rear end surface of the rear insulator, and an outer ring end surface, the cable crimping ring being connected with the front shell in a positioned manner by an interference fit between the outer ring end surface of the cable crimping ring and the inner ring surface of the front shell; and a cable clamping assembly, arranged in the inner cavity of the rear protective sleeve, and having a clamping surface formed thereon for clamping on an outer ring surface of an outer conductor of a cable to be connected;

wherein the cable clamping assembly comprises a base and a cable clamp, the base being connected to the rear protective sleeve by an interference fit between an outer ring surface of the base and a corresponding inner ring surface of the rear protective sleeve, wherein the cable clamp has a rear end barb structure clamped in a corresponding slot hole of the base, and a clamping surface formed on an inner end ring surface thereof.

2. The RF coaxial cable connector of claim 1, further comprising a first sealing ring sleeved on an inner side of a blocking protrusion of an outer ring end face of the front shell, wherein once the cable is connected in place, an outer ring surface of the first sealing ring is tightly attached to an inner ring surface of the rear protective sleeve.

3. The RF coaxial cable connector of claim 1, wherein the cable clamp has a circular ring structure formed by four sections spliced in a circumferential direction, each of the sections of the cable clamping has a rear end barb structure positioned in the corresponding slot hole.

4. The RF coaxial cable connector of claim 3, wherein the cable clamping structure comprises a first protrusion, an inner concave section and a second protrusion, which form a clamping structure.

5. The RF coaxial cable connector of claim 1, wherein, the cable clamp is sleeved with an O-shaped ring on a front outer ring surface thereof, and a clamping spring on a rear outer ring surface thereof; while the cable is connected in place, the outer ring surface formed on the cable clamp is pushed into the inner cavity in a rear end of the front shell.

6. The RF coaxial cable connector of claim 5, wherein, the slot hole is provided with a clamping spring mounting cavity, in which the clamping spring is positioned and sleeved on a rear end outer ring surface of the cable clamp.

7. The RF coaxial cable connector of claim 1, wherein, the base is provided with an axial rear protruding ring which is configured to be inserted into a corresponding mounting slot of the rear protective sleeve, a sealing ring is arranged between a rear end of the axial rear protruding ring and an inner end wall of the mounting slot, an inner ring surface of the sealing ring is sleeved on an outer ring surface of the protective sleeve of the cable to be connected while assembled.

8. The RF coaxial cable connector o of claim 7, wherein, while pre-installed, a gap is provided between a rear end surface of a main body of the base and a corresponding positioning end surface of the rear protective sleeve, and the axial rear protruding ring has an inclined rear end ring surface; during crimping, by means of the rear end surface of the main body of the base and the positioning end surface of the rear protective sleeve, which are served as limiting surfaces, the sealing ring is squeezed and deformed for sealing.

9. The RF coaxial cable connector of claim 1, wherein the diameter of the first positioning hole is smaller than that of the first through-hole.

* * * * *